US007219480B2

(12) United States Patent
Winters et al.

(10) Patent No.: US 7,219,480 B2
(45) Date of Patent: May 22, 2007

(54) CAPPING AND NITROGEN DOSING APPARATUS

(75) Inventors: Bernard A. Winters, Carmel, IN (US); William A. Moll, IV, Bloomingdale, IN (US); Larry W. Ellis, Cattaraugus, NY (US)

(73) Assignee: Alcoa Closure Systems International, Inc., Crawfordsville, IN (US)

( * ) Notice: Subject to any disclaimer, the term of this patent is extended or adjusted under 35 U.S.C. 154(b) by 0 days.

(21) Appl. No.: 10/635,302

(22) Filed: Aug. 6, 2003

(65) Prior Publication Data

US 2005/0028487 A1 Feb. 10, 2005

(51) Int. Cl.
*B65B 31/00* (2006.01)
*B65B 7/28* (2006.01)

(52) U.S. Cl. ..... 53/403; 53/432; 53/485; 53/510; 53/282; 53/287; 141/64

(58) Field of Classification Search ..... 53/403, 53/432, 484, 485, 137.1, 287, 281, 282, 510; 141/64, 82, 144, 63, 66
See application file for complete search history.

(56) References Cited

U.S. PATENT DOCUMENTS

| | | | | |
|---|---|---|---|---|
| 3,837,137 | A | 9/1974 | Yatsushiro et al. | |
| 4,588,000 | A * | 5/1986 | Malin et al. | 141/1 |
| 4,848,419 | A | 7/1989 | Damen | |
| 4,865,088 | A | 9/1989 | Stearns | 141/5 |
| 4,870,801 | A | 10/1989 | Mizandiian et al. | |
| 4,998,400 | A | 3/1991 | Suzuki et al. | |
| 5,009,901 | A | 4/1991 | Byrne | |
| 5,396,934 | A | 3/1995 | Moench | |
| 5,517,804 | A | 5/1996 | Lynch | |
| 5,802,812 | A * | 9/1998 | Heudecker | 53/431 |
| 6,182,715 | B1 | 2/2001 | Ziegler et al. | |
| 6,189,299 | B1 | 2/2001 | Brown et al. | |
| 6,199,350 | B1 | 3/2001 | Brechel et al. | |
| 6,379,731 | B1 | 4/2002 | Brown et al. | |
| 6,502,369 | B1 * | 1/2003 | Andison et al. | 53/432 |
| 6,584,781 | B2 * | 7/2003 | Bishop et al. | 62/54.1 |
| 2004/0000127 | A1 * | 1/2004 | Joshi et al. | 53/431 |

FOREIGN PATENT DOCUMENTS

| | | |
|---|---|---|
| EP | 0 798 263 A | 10/1997 |
| JP | 59001899 | 1/1984 |
| JP | 62124398 | 6/1987 |

* cited by examiner

*Primary Examiner*—Rinaldi I. Rada
*Assistant Examiner*—John Paradiso
(74) *Attorney, Agent, or Firm*—Wood, Phillips, Katz, Clark & Mortimer

(57) ABSTRACT

A capping and nitrogen dosing apparatus for containers includes a rotary capping machine which is configured to serially receive filled containers, and apply closures to respective ones of the containers. The present apparatus includes a dosing system for injecting an inert gas, typically nitrogen in liquid form, into the head space of each container to enhance the integrity and rigidity of the package, and to improve the freshness and flavor of the container's contents. Notably, the dosing system is configured to effect nitrogen injection close to or at the so-called transfer point of the capping machine, thus desirably abating nitrogen dissipation, and enhancing consistent and efficient product dosing.

12 Claims, 2 Drawing Sheets

CAPPING AND NITROGEN DOSING APPARATUS

TECHNICAL FIELD

The present invention relates generally to a capping apparatus for applying closures to containers at high speed, and more particularly to a capping apparatus including a nitrogen dosing system for dispensing nitrogen into a head space of each of the containers prior to closure application by the apparatus.

BACKGROUND OF THE INVENTION

Injection or "dosing" of nitrogen ($N_2$) into containers has come into increasingly widespread practice in packaging of non-carbonated contents in order to increase package rigidity (by increasing internal pressure), as well as for enhancing shelf life, flavor, and freshness of a container's contents. Nitrogen injection systems typically employ liquid nitrogen, which gasifies attendant to container dosing.

While current nitrogen dispensing systems typically provide accurate dispensing of nitrogen, process parameters apart from the injection system create variability which acts to limit the effectiveness of traditional injection systems. Typically, injection systems employed heretofore introduce nitrogen into a container, such as on a bottling line, well in advance of the point at which a closure is applied to a container, sealing it. In such arrangements, the nitrogen, which may be in liquid form, comes to rest on top of the product being packaged, and depending on the fill level, distance from point of closure application, and amount of product spillage that occurs as the package is placed in a position to be sealed, the effectiveness of the nitrogen dose can vary. In total, all of these variables undesirably act to reduce the effectiveness and reliability of current nitrogen dosing systems.

The present invention is directed to a capping apparatus including a nitrogen dosing system which has been specifically configured to overcome shortcomings associated with previously known arrangements by effecting injection of nitrogen, or a like inert gas, into containers just prior to application of a closure to each container by the apparatus.

SUMMARY OF THE INVENTION

A capping and nitrogen dosing apparatus embodying the principles of the present invention includes a rotary capping machine including a rotatably driven turret for serially receiving a plurality of containers, typically bottles. The apparatus of the present invention includes a nitrogen dosing system including a dispensing nozzle which is positioned to direct nitrogen, typically in liquid form, directly through the mouth of each container as the container moves through the capping machine past the dispensing nozzle. By this arrangement, nitrogen dissipation is desirably minimized, enhancing operating efficiency. In the preferred form, operation of the dosing system is electronically coordinated with operation of the capping machine to facilitate consistent operation, permitting the dosing system to be operated either continually, or intermittently, as desired.

In accordance with the illustrated embodiment, the rotary capping machine of the apparatus includes a plurality of capping heads for applying closures to respective ones of the containers as the containers are moved about a generally circular path by the rotary turret of the capping machine. The capping machine may be of a generally conventional configuration, with associated rotary conveyors, or starwheels, operatively associated with the capping machine for supplying filled, but unsealed containers to the machine, and for receiving filled and sealed containers from the machine.

The nitrogen dosing system of the present invention is configured for dispensing nitrogen, typically in liquid form, into a head space of each of the containers received by the capping machine prior to application of a respective closure thereto. As is known by those familiar with the art, the head space of a container is that upper region of a container which is unfilled with the typically liquid contents of the container. Injection of nitrogen into this region of containers having non-carbonated contents desirably acts to enhance package rigidity (by internal pressurization) for more secure handling, stacking, and dispensing (such as from vending machines) of products, and desirably acts to enhance the freshness and flavor of the package contents.

Significantly, the present apparatus is configured to effect nitrogen injection at, or in close relationship to, the so-called transfer point of the capping machine, that is, the theoretical point at which the package is positioned for closure application. As will be appreciated, this is in significant distinction from systems employed heretofore, where nitrogen has typically been injected into containers well before closure application, typically before the containers were even received by a capping machine.

To this end, the nitrogen dosing system of the present apparatus includes a generally elongate dispensing nozzle which intersects the circular path about which the containers are moved by the capping machine, at a position between each container and the respective one of the closures held by one of the capping heads. The dosing system includes a control valve to selectively permit intermittent or continuous dispensing of nitrogen, with a control system provided for coordinating operation of the dosing system with operation of the capping machine.

The dispensing nozzle of the dosing system defines a downwardly opening discharge outlet at a free end portion thereof, positionable between each container and a respective one of the closures. In a preferred form, the free end portion of the dispensing nozzle is configured to provide clearance with the capping heads of the capping machine. By this configuration of the dispensing nozzle, nitrogen is directed downwardly through the open mouth of each container as it is being moved by the capping machine, with closure application initiated very shortly after each container is moved passed the dispensing nozzle, that is, after the capping heads clear the dispensing nozzle. Dissipation of the nitrogen as can occur attendant to container movement is desirably minimized to enhance consistent product dosing.

A method of capping containers, including dosing of each container with nitrogen, is also disclosed.

Other features and advantages of the present invention will become readily apparent from the following detailed description, the accompanying drawings, and the appended claims.

DETAILED DESCRIPTION

Figure 1:
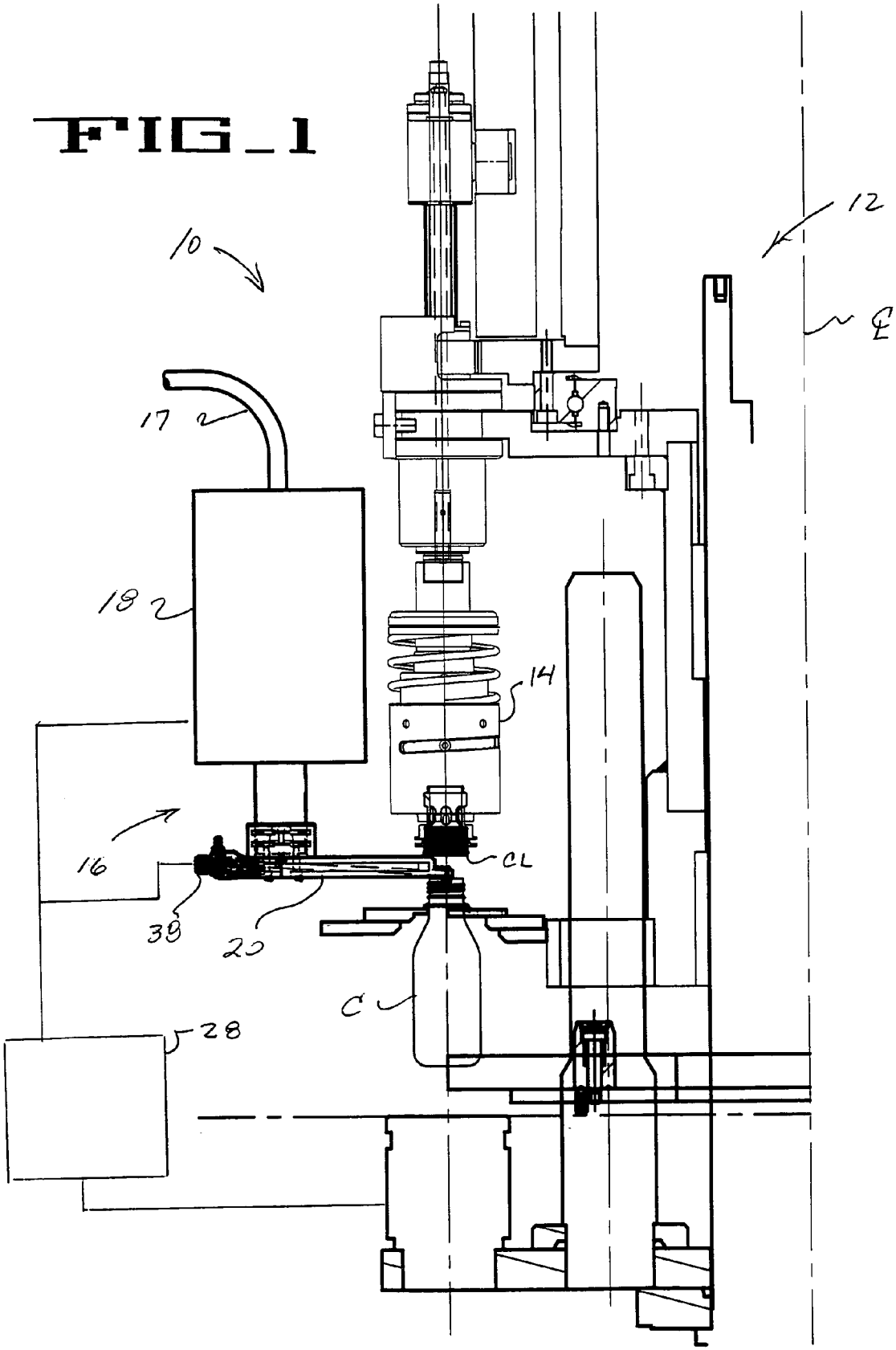
FIG. 1 is side elevational, diagrammatic view of a capping and nitrogen dosing apparatus embodying the principles of the present invention.

While the present invention is susceptible of embodiment in various forms, there is shown in the drawings, and will hereinafter be described, a presently preferred embodiment, with the understanding that the present disclosure is to be considered as an exemplification of the invention, and is not intended to limit the invention to the specific embodiment illustrated.

With reference to FIG. 1, therein is illustrated capping and dosing apparatus 10 embodying the principals of the present invention. As will be further described, the present apparatus includes a rotary capping machine which is configured for high speed application of closures to associated bottles or like containers. As will be recognized by those familiar with the art, this type of machine serially receives filled bottles from an associated in-feed conveyor or so-called starwheel, with a machine being configured to substantially continuously apply threaded closures to respective ones of the containers as they are moved through the machine about a generally circular path. The closures are typically applied by rotation to inter-engage the screw threads of each closure with its respective container before the container is moved out of the machine and received by an associated output conveyor or starwheel. Capping machines of this nature are available from Alcoa Closure Systems International, Indianapolis, Ind., such as under model designation Series 7000, with such machines typically employing capping heads, such as the Magna Torq 2000, available from Alcoa Closure Systems International. While such equipment exemplifies the configuration of the present invention, it is to be understood that the present capping and dosing apparatus can be configured to operate in accordance with the principles of the present invention by use of other, like equipment, including linear or in-line capping machines.

The nitrogen dosing system of the present apparatus may also be generally configured in accordance with known nitrogen dosing systems, such as available from VBS Industries, Inc., of Campbell Calif. See, for example, U.S. Pat. No. 6,182,715, hereby incorporated by reference. In distinction from arrangements known heretofore, the dosing system of the present system has been integrated with the capping machine to facilitate injection of nitrogen, or another inert gas, into each of the containers being filled just prior to application of the closure to the container. In accordance with the present invention, this is effected by providing the dosing system with a dispensing nozzle which is positioned to extend generally into and intersect the circular path about which the filled containers are moved by the capping machine.

Figure 2:
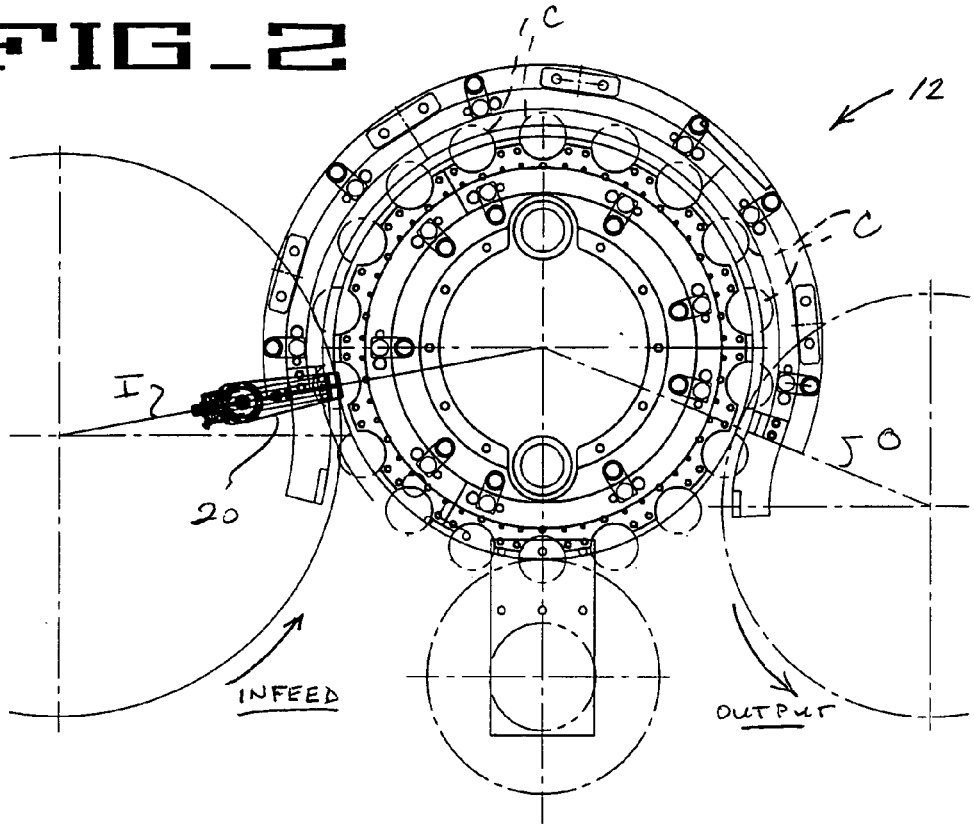
FIG. 2 is a plan, diagrammatic view of the present apparatus.
Figure 3:
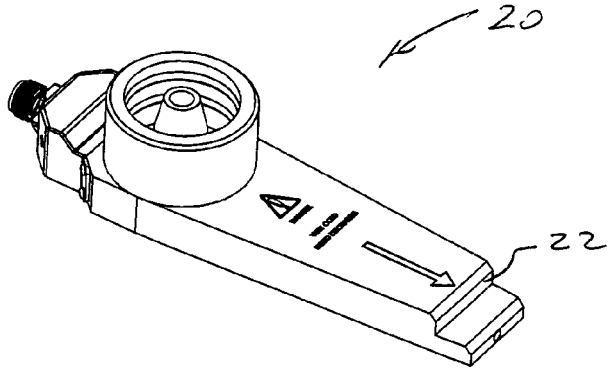
FIG. 3 is a relatively enlarged, perspective view of a nitrogen dispensing nozzle of the dosing system of the present apparatus.
Figure 4:
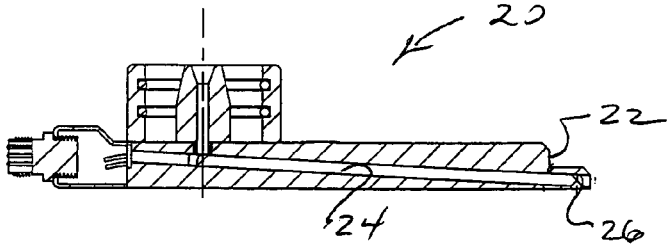
FIG. 4 is a cross-sectional view of the dispensing nozzle shown in FIG. 3.

With further reference to FIG. 1, and with reference also to FIG. 2, the present apparatus includes a capping machine 12, as described above. Capping machine 12 is configured to receive containers C, such as bottles, from an infeed conveyor or starwheel along a circular path designated "infeed" in FIG. 2, and to deliver the filled and sealed containers to an output conveyor or starwheel along a circular path designated "output" in FIG. 2. The capping machine 12 includes a rotatably driven carrier or turret which rotates around a centerline (FIG. 1) and moves the containers C along and about a generally circular path which intersects the circular paths defined by the input and output starwheels.

As the containers C are moved about the circular path by the capping machine 12, the closures, designated CL in FIG. 1 are applied to a respective one of the containers. To this end, the capping machine includes a plurality of capping heads 14 (see FIG. 1). Each of the capping heads 14 is rotatably driven so that a closure CL received thereby can be positioned above a respective one of the containers C, and the closure rotated downwardly onto the container into sealing relationship therewith, closing the container and completing packaging of its contents.

As containers C are handled by the capping machine 12, the containers each move along the generally circular path defined by the capping machine from an input point shown by line I to an output point shown by line O (FIG. 2). As will be recognized by those familiar with the art, the input point is sometimes referred to as the transfer point, that is, the theoretical point at which filled container C is positioned for receiving a closure thereon.

In accordance with the present invention, dosing of an inert gas, typically nitrogen ($N_2$) in liquid form, is effected as close to the transfer point as possible to facilitate consistent dosing of the containers C by minimizing dissipation of the nitrogen as can occur attendant to container movement and product spillage. To this end, the present invention includes a nitrogen dosing system 16 positioned in operative association with the capping machine 12. The dosing system 16 receives a supply of inert gas, typically nitrogen in liquid form via a supply conduit 17, with the nitrogen delivered to a vacuum insulated reservoir 18, and then to dispensing nozzle 20 configured and positioned in accordance with the principles of the present invention.

As illustrated in FIG. 2, dispensing nozzle 20 intersects the circular path about which containers are moved by the rotatably driven turret of the capping machine 12, with the dispensing nozzle being positioned between each of the containers C and a respective one of the closures CL being held by one of the capping heads 14 of the capping machine. To facilitate disposition in this manner, the dispensing nozzle 20 is of a generally elongated configuration, and is configured to provide clearance with the capping heads 14 by the provision of a free end portion having a stepped configuration at 22. Nitrogen is delivered through the dispensing nozzle through an internal passage 24, with the nozzle defining a downwardly opening discharge outlet 26 at the free end portion thereof. By this configuration, the dispensing nozzle 20 is positioned to dispense nitrogen downwardly directly through the open mouth of each of the containers C received by the rotary turret of the capping machine 12 just prior to application of a closure CL to each of the containers by one of the capping heads 14. Again, disposition of the dispensing nozzle 20 at the so-called transfer point of the capping machine greatly facilitates consistent dosing of the containers with nitrogen. Not only does the present apparatus desirably provide consistent positioning of the container package for dosing, the package is substantially stabilized, reducing or eliminating further potential for product spillage, allowing for full retention of nitrogen. Additionally, dosing just prior to closure application minimizes the time during which the nitrogen can dissipate.

In accordance with the present invention, the dosing system 16 can be operated to continuously dispense nitrogen from the dispensing nozzle 20, or can be operated to intermittently dispense nitrogen from the dispensing nozzle, in coordination with movement of container C past the dispensing nozzle by the rotating turret of the capping machine 12. In the preferred form of the present invention, electronic controls 28 are provided which are operatively connected with the electronic controls of the capping machine for accurate timing of the nitrogen dosing system. Dispensing nozzle 20 can be provided with a suitable fitting 38 which permits a suitable device to be positioned within the nozzle such as for controlling and monitoring operation of the system. By electronically controlling the dosing system, and coordinating its operation with the capping machine 12, the present apparatus provides more accurate dosing throughout the entire speed range of the capping machine, with discrete dosing at higher speeds desirably eliminating the continuous stream which has heretofore frequently been required for properly injecting nitrogen into various types of packages typically used today. Intermittent operation in this fashion desirably results in substantial cost savings, which can be realized by reducing the amount of liquid nitrogen used, in comparison to a continuous stream process. Coordinating operation of the dosing system with the capping machine desirably permits accurate, intermittent dosing even attendant to modulation in the speed of the capping machine 12.

From the foregoing, numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A method of capping containers, comprising the steps of:

providing a capping machine including a rotatably driven turret, and a plurality of capping heads;

serially directing a plurality of containers onto said turret of said capping machine, and moving said container about a generally circular path;

operating said capping heads to apply closures to respective ones of said containers as said containers are moved about said circular path;

providing a dispensing nozzle having a generally elongate configuration and extending from a position outwardly of said generally circular path for disposition of said free end portion between each said container and the respective one of said closures just prior to application of each of said closures to the respective one of said containers, with a free end portion of said dispensing nozzle intersecting said circular path, and with a downwardly open discharge opening defined by said dispensing nozzle being positioned at said circular path to direct liquid nitrogen downwardly into each said container when each container and respective one of said closures are respectively positioned, dispensing discrete liquid nitrogen doses from said dispensing nozzle into the head space of each said container received by said capping machine after it is received by said turret and, where the liquid nitrogen is dispensed above said container contents, just prior to application of a respective closure thereto, where a control system electronically coordinates liquid nitrogen dispensing with operation of said capping machine, where dispensing liquid nitrogen is integrated electrically and mechanically with the capping machine, permitting dispensing liquid nitrogen to be operated intermittently and to facilitate consistent operation and dispensing of liquid nitrogen, where the liquid nitrogen is dispensed at or in close relationship to the theoretical point at which the container is positioned for closure application, said liquid nitrogen gasifying attendant to container closing.

2. A method of capping containers in accordance with claim 1, wherein:

said steps of dispensing liquid nitrogen includes the dispensing nozzle intersecting said circular path positioned between each said container and its respective closure, where said nitrogen is acting to enhance container rigidity by internal pressurization, and where dissipation of nitrogen is minimized to enhance consistent dispensing of the liquid nitrogen.

3. A method of capping containers in accordance with claim 2, including:

continuously dispensing liquid nitrogen from said dispensing nozzle.

4. A method of capping containers in accordance with claim 2, including:

intermittently dispensing liquid nitrogen from said dispensing nozzle.

5. A method of capping containers in accordance with claim 1, where the nitrogen acts to enhance the freshness of the contents and more secure handling of the containers.

6. A capping and nitrogen dosing apparatus, comprising:

a rotary capping machine including a rotatably driven turret for serially receiving a plurality of containers, and a plurality of capping heads for applying closures to respective ones of said containers as said containers are moved about a generally circular path by said turret, a nitrogen dosing system for dispensing liquid nitrogen into a head space of each of said containers received by said capping machine, above container contents, just prior to application of a respective closure thereto, said dosing system integrated with the capping machine and including a dispensing nozzle which intersects said circular path about which said containers are moved at a position between each said container and the respective one of said closures held by one of said capping heads, where the liquid nitrogen is dispensed with discrete dosing at or in close relationship to the theoretical point at which the container is positioned for closure application, said liquid nitrogen gasifying attendant to container dosing, said dispensing nozzle having a generally elongate configuration and extending from a position outwardly of said generally circular path, with a free end portion of said dispensing nozzle intersecting said circular path for disposition of said free end portion between each said container and the respective one of said closures just prior to application of each of said closures to the respective one of said containers, and with a downwardly open discharge opening defined by said dispensing nozzle being positioned at said circular path to direct liquid nitrogen downwardly into each said container when each container and respective one of said closures are respectively positioned, and a control system for electronically coordinating operation of said nitrogen dosing system with operation of said capping machine where the dosing system is integrated electrically and mechanically with the capping machine, permitting the dosing system to be operated continually or intermittently and to facilitate consistent operation and dosing with nitrogen, and the nitrogen acts to enhance the freshness of the contents and more secure handling of the containers.

7. A capping and nitrogen dosing apparatus in accordance with claim 6, wherein:

said dosing system includes a control valve to selectively permit intermittent and continuous dispensing of liquid nitrogen.

8. A capping and nitrogen dosing apparatus in accordance with claim 6, wherein:

said downwardly open discharge outlet at said free end portion is positionable between each said container and a respective one of said closures, where said nitrogen is acting to enhance container rigidity by internal pressurization, and where dissipation of nitrogen is minimized to enhance consistent product dosing.

9. A capping and nitrogen dosing apparatus in accordance with claim 8, wherein:

said free end portion of said dispensing nozzle is configured to provide clearance with said capping heads.

10. A capping and nitrogen dosing apparatus, comprising:

a capping machine including a driven carrier for serially receiving a plurality of containers, and a plurality of capping heads for applying closures to respective ones of said containers as said containers are moved along a path by said carrier, a nitrogen dosing system for dispensing liquid nitrogen into a head space of each of said containers received by said capping machine, above container contents, just prior to application of a respective closure thereto, said dosing system integrated with the capping machine and including a dispensing nozzle which intersects said path along which said containers are moved at a position between each said container and the respective one of said closures held by one of said capping heads, where the liquid nitrogen is dispensed with discrete dosing at or in close relationship to the theoretical point at which the container is positioned for closure application, said liquid nitrogen gasifying attendant to container dosing, and a control system for electronically coordinating operation of said nitrogen dosing system with operation of said capping machine where the dosing system is integrated electrically and mechanically with the capping machine, permitting the dosing system to be operated continually or intermittently and to facilitate consistent operation and dosing with nitrogen, and the nitrogen acts to enhance the freshness of the contents and more secure handling of the container, said dispensing nozzle having a generally elongate configuration and extending from a position outwardly of said path for disposition of said free end portion between each said container and the respective one of said closures just prior to application of each of said closures to the respective one of said containers, with a free end portion of said dispensing nozzle intersecting said circular path, and with a downwardly open discharge opening defined by said dispensing nozzle being positioned at said path to direct liquid nitrogen downwardly into each said container when each container and respective one of said closures are respectively positioned.

11. A capping and nitrogen dosing apparatus in accordance with claim 10, wherein:

said a downwardly open discharge outlet at said free end portion is positionable between each said container and a respective one of said closures, liquid nitrogen is dispensed at or in close relationship to the theoretical point at which the container is positioned for closure application, and where dissipation of nitrogen is minimized to enhance consistent product dosing.

12. A capping and nitrogen dosing apparatus in accordance with claim 10, wherein:

said carrier of said capping machine comprises a rotatably driven turret for moving said containers along a generally circular path, and where said nitrogen is acting to enhance container rigidity by internal pressurization.

* * * * *